US010988864B2

(12) United States Patent
Hubert et al.

(10) Patent No.: US 10,988,864 B2
(45) Date of Patent: Apr. 27, 2021

(54) DEVICE FOR ENTANGLING A PLURALITY OF INDIVIDUAL THREADS OF A COMPOSITE THREAD

(71) Applicant: OERLIKON TEXTILE GMBH & CO. KG, Remscheid (DE)

(72) Inventors: Christian Hubert, Neumünster (DE); Ludger Legge, Ehndorf (DE); Jan Westphal, Schülp (DE); Eike Holle, Hamburg (DE); Mathias Stündl, Wedel (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 330 days.

(21) Appl. No.: 15/883,702

(22) Filed: Jan. 30, 2018

(65) Prior Publication Data

US 2018/0216259 A1 Aug. 2, 2018

(30) Foreign Application Priority Data

Feb. 1, 2017 (DE) ..... 10 2017 000 886.8

(51) Int. Cl.

| | |
|---|---|
| ***D01D 11/04*** | (2006.01) |
| ***D02J 1/08*** | (2006.01) |
| ***D01D 10/04*** | (2006.01) |
| ***D02G 1/16*** | (2006.01) |
| ***D01D 5/08*** | (2006.01) |
| ***D01D 13/02*** | (2006.01) |
| ***D01D 5/22*** | (2006.01) |

(52) U.S. Cl.

CPC ..... *D02G 1/161* (2013.01); *D01D 5/08* (2013.01); *D01D 5/22* (2013.01); *D01D 10/0481* (2013.01); *D01D 11/04* (2013.01); *D01D 13/02* (2013.01); *D02G 1/16* (2013.01); *D02J 1/08* (2013.01)

(58) Field of Classification Search

CPC .. D02G 1/16; D02G 1/161; D02J 1/08; D01D 5/08; D01D 5/22; D01D 10/0481; D01D 11/04; D01D 13/02

See application file for complete search history.

(56) References Cited

U.S. PATENT DOCUMENTS

| | | | | |
|---|---|---|---|---|
| 3,237,269 A * | 3/1966 | Hawkins | ..... | D02J 1/08 28/272 |
| 4,639,986 A * | 2/1987 | Borenstein | ..... | D02J 1/08 28/272 |
| 5,715,584 A * | 2/1998 | Coons, III | ..... | D02G 1/161 28/140 |

FOREIGN PATENT DOCUMENTS

| | | |
|---|---|---|
| DE | 4329400 | 3/1995 |
| EP | 0811711 | 12/1997 |

* cited by examiner

*Primary Examiner* — Xiao S Zhao
*Assistant Examiner* — Joseph S Leyson
(74) *Attorney, Agent, or Firm* — BainwoodHuang

(57) ABSTRACT

Various techniques involve a device for entangling a plurality of individual threads of a composite thread in a melt-spinning process for the production of crimped yarns. The device to this end has a plurality of entanglement nozzles which are collectively held on a support. In order to enable a flexible utilization of the entanglement nozzles and of thread guiding, the entanglement nozzles on the support are assigned at least one thread guide in such a manner that the threads are guidable optionally in the entanglement nozzles and/or in the thread guide.

14 Claims, 4 Drawing Sheets

Figure 1:
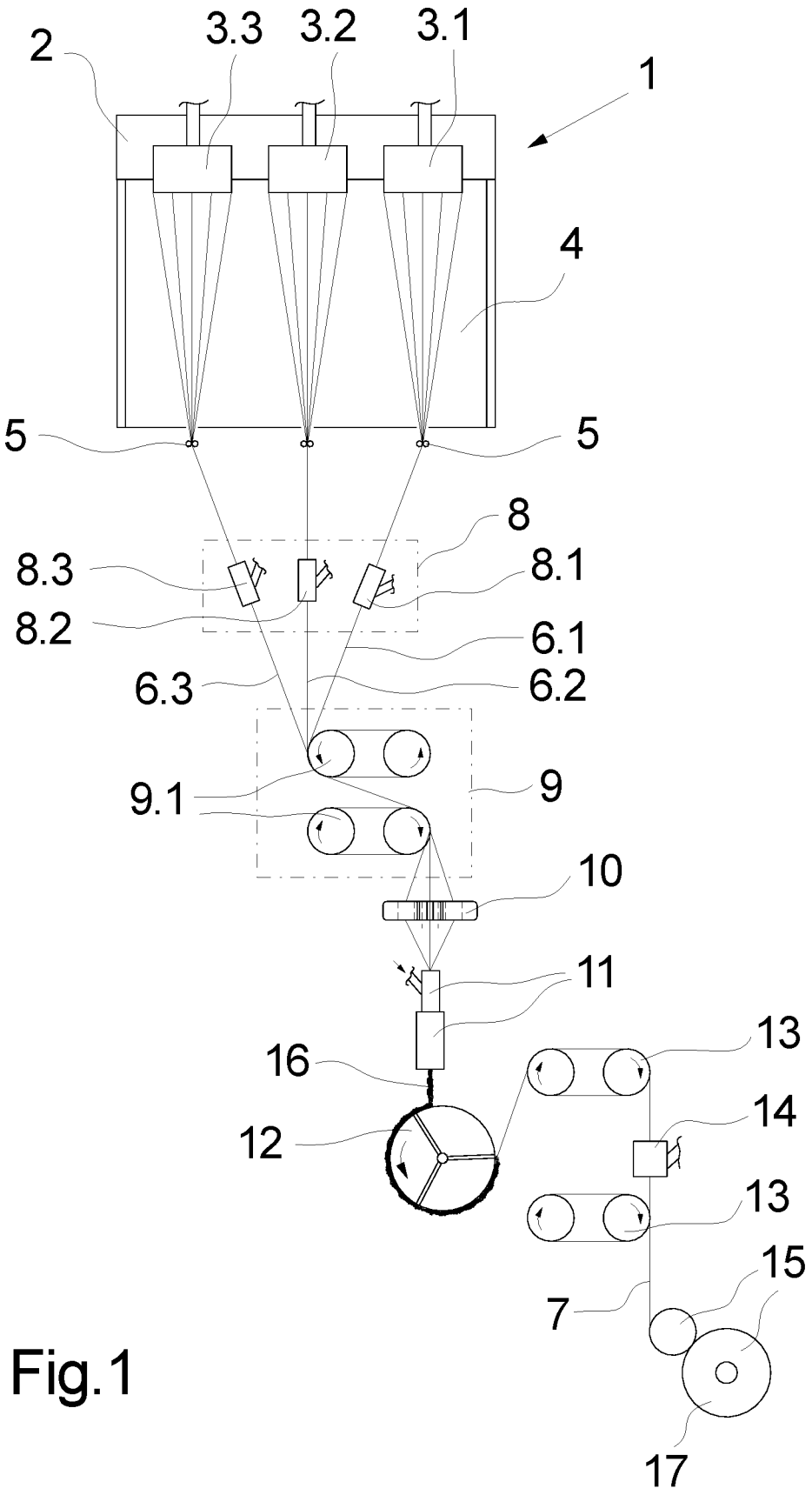

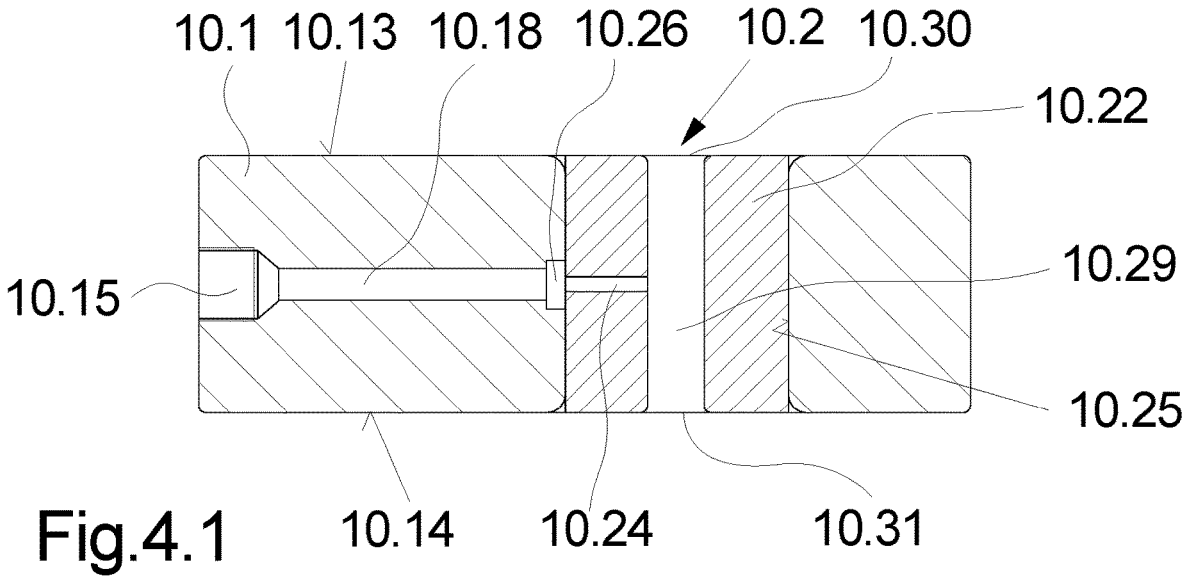
Fig.4.1
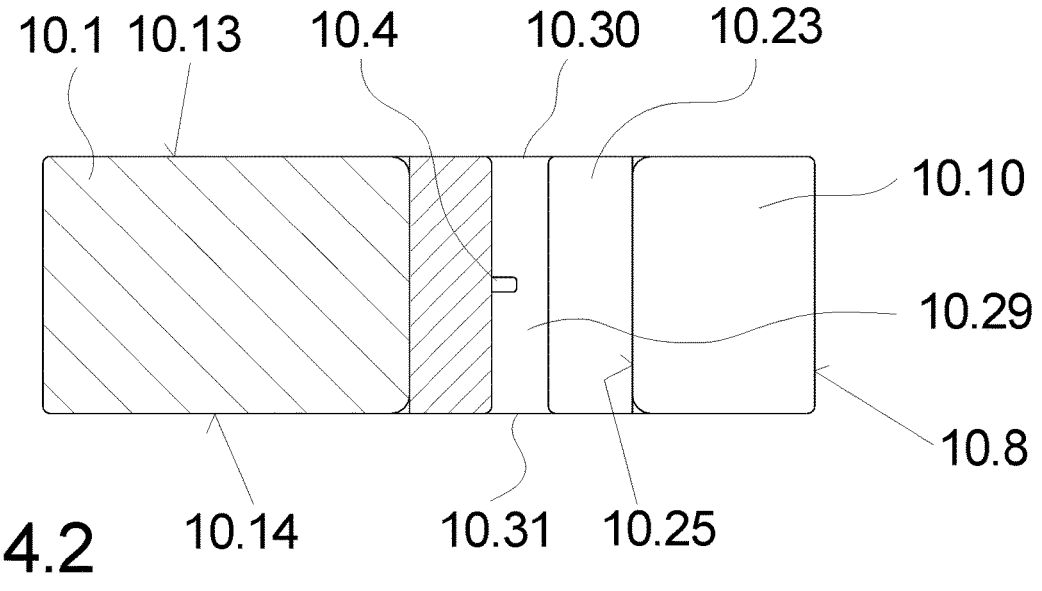
Fig.4.2

DEVICE FOR ENTANGLING A PLURALITY OF INDIVIDUAL THREADS OF A COMPOSITE THREAD

The invention relates to a device for entangling a plurality of individual threads of a composite thread as disclosed herein.

In the production of multi-coloured carpet yarns, a plurality of differently dyed individual threads are usually generated in a melt-spinning process and gathered so as to form a composite thread. The individual threads of the composite thread herein are entangled in a mutually separate manner prior to being collectively crimped. To this end, a device of the generic type such as is known, for example, from WO 2006/081844 is used.

In the case of the known device, a total of three entanglement nozzles are held beside one another in a sequential arrangement, so as to entangle the individual threads of a composite thread in a mutually independent manner. The entanglement nozzles are supplied in a mutually separate manner with in each case one controllable compressed air stream, such that an individual entanglement of the individual threads is possible at each of the entanglement nozzles. Different colour effects which in the composite thread lead to a mixed colour or to multiple colours can thus be implemented in the composite thread.

In order to meet the rapidly changing fashion trends and thus the ever changing requirements for carpet yarns, there is in practice the desire for composite threads of this type to be able to be produced with high flexibility. Moreover, physical properties that are as uniform as possible are to be implemented on the individual threads such that the composite thread is of high quality.

It is therefore the object of the invention to refine the device of the generic type for entangling a plurality of individual threads of a composite thread in such a manner that the composite thread is producible with an even larger spectrum of colours.

A further object of the invention lies in configuring the device of the generic type in such a manner that a gentle treatment of threads is possible.

This object is achieved according to the invention in that the entanglement nozzles on the support are assigned at least one thread guide in such a manner that the individual threads are guidable optionally in the entanglement nozzles and/or in the thread guide.

Advantageous refinements of the invention are defined by the features and the combinations of features as disclosed herein.

The invention is based on the concept that the individual threads in the melt-spinning process are preferably guided as a composite on the circumference of godets before said individual threads collectively reach the texturing nozzle for crimping. Therefore, by way of the thread guide that is held on the support it is possible for the individual threads to be guided to crimping collectively as a composite, without entanglement. However, there is alternatively also the possibility for all or single ones of the individual threads to be distributed among the entanglement nozzles in order for further colour effects to be obtained. It is essential herein that the individual threads that are guided in the thread guide can be guided without any deflection in the thread run between a godet and a texturing nozzle.

In order for the same guide properties to be obtained as far as possible on each of the individual threads in the entanglement of the individual threads, the refinement of the invention in which the thread guide is held on the support at a constant spacing from the entanglement nozzles is preferably embodied. A deflection of identical size in the thread run can thus be generated on each of the individual threads.

This measure can yet be improved in that the entanglement nozzles form a reference circle about the thread guide, and in which the entanglement nozzles are disposed on the reference circle at a regular pitch. In particular, the reproducibility of specific mixing effects that are generated by the entanglement of the individual threads can be guaranteed herewith. Apart from an identical deflection of the individual threads, the gathering of the individual threads in the run-in into a texturing nozzle can also be homogenized.

In order for the non-entangled individual threads to be guided in a reliable manner, it is furthermore provided that the thread guide is formed by a U-shaped guide member which is disposed on a groove base of a guide groove that penetrates the support at the end side. The guide member that is held on the support by way of a corresponding choice of material is particularly suitable for not wearing in the case of contact with the individual threads. Moreover, the guide groove that is configured on the support even in the case of non-contacting guiding guarantees a separation between the individual threads in the case of a partial separation of the composite thread.

In order for the individual threads to be guidable through the entanglement nozzles at deflection angles that are as small as possible, the refinement according to the invention in which at least one of the entanglement nozzles is formed by an insert member which is held in a receptacle opening of the support is particularly advantageous. The entanglement nozzles can thus be held on the support at a small pitch.

In order for handling at the beginning of the process to be improved, the refinement in which the support is configured so as to be plate-shaped and has a placing slot that is open towards an end side or towards the guide groove and opens laterally into the receptacle opening is preferably embodied, wherein the receptacle opening and the placing slot penetrate the support from an upper side to a lower side. The placing slot herein can penetrate the support at any arbitrary location and by way of an arbitrary profile, such that thread guiding by way of a suction pistol is possible at the beginning of the process.

In order for the entanglement nozzle to be supplied with compressed air, a supply bore which extends between the receptacle opening and a compressed air connector that is configured on a distal end side of the support is configured within the support. The insert member can thus be advantageously combined with the compressed air connector and the placing slot.

In order to be able to operate the entanglement nozzles individually at a pitch that is as small as possible, it is furthermore provided that the support for each entanglement nozzle has separate receptacle openings, separate placing slots, and separate supply ducts having separate compressed air connectors. Each entanglement nozzle can thus be impinged by a compressed air stream in a mutually independent manner.

In order for long service lives to be guaranteed, the insert member is preferably formed from a wear-resistant material, wherein the insert member for guiding one of the individual threads has a continuous guide duct which by way of a longitudinal slot is connected to the placing slot in the support and by way of a transverse slot is connected to the supply duct in the support. The thread can thus be introduced into the guide duct in a simple manner, on the one hand. In operation, a continuous compressed air stream, that is transverse to the guide duct, can be generated for entangling the individual thread by way of the transverse slot.

Depending on the respective melt-spinning method, it is possible for a plurality of composite threads to be pieced simultaneously or separately in a sequential manner on the circumference of godets. In the case of so-called selective thread guiding, the refinement of the invention in which the support has a protruding support arm which has an auxiliary thread guide that is spaced apart so as to be opposite the thread guide is particularly advantageous, the threads when being pieced being able to be guided through said auxiliary thread guide so as to be temporarily parked therein. The threading of the threads at the beginning of the process is thus substantially facilitated, and the device according to the invention, independently of the melt-spinning method, is suitable for treating the plurality of composite threads that are in parallel beside one another.

The device according to the invention for entangling a plurality of individual threads of a composite thread will be described in more detail hereunder by means of an exemplary embodiment.

Figure 2:
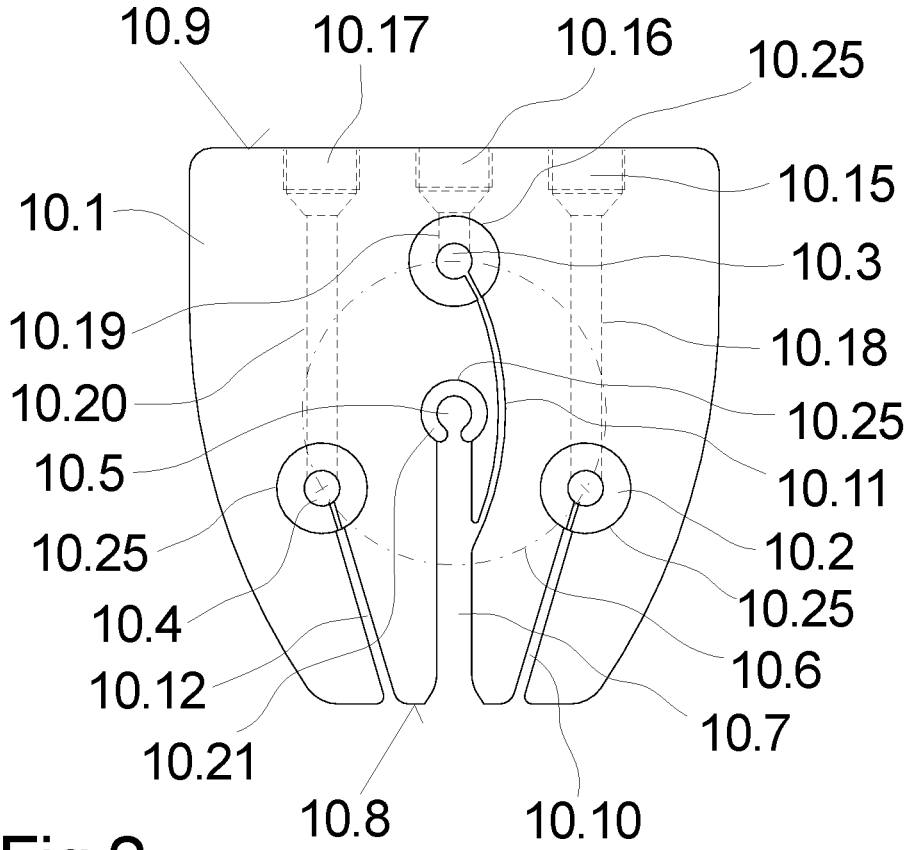
Figure 3:
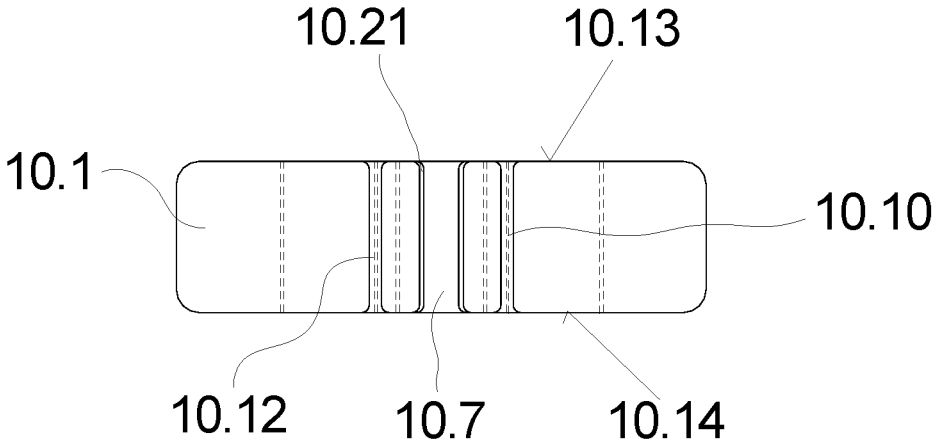

In the figures:

FIG. 1 schematically shows an exemplary embodiment of the device according to the invention in a melt-spinning process for the production of crimped yarns;

FIG. 2 schematically shows a plan view of an exemplary embodiment of the device according to the invention for entangling a plurality of individual threads;

FIG. 3 schematically shows a side view of the exemplary embodiment from FIG. 2;

FIG. 4.1 and

Figure 5:
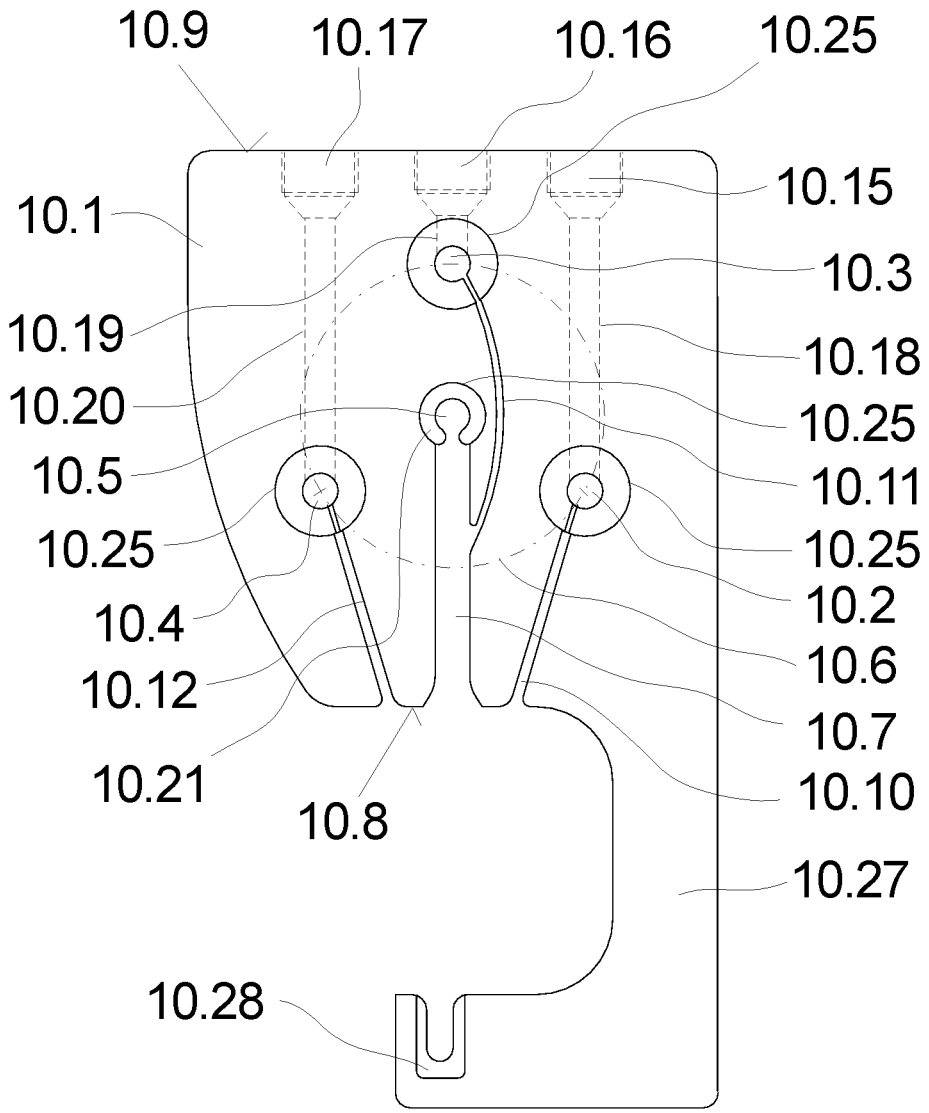

FIG. 4.2 schematically show a plurality of cross-sectional views of the exemplary embodiment from FIG. 2;

FIG. 5 schematically shows a plan view of a further exemplary embodiment of the device according to the invention for entangling individual threads.

A melt-spinning process for the production of a crimped yarn, in which the device according to the invention for entangling a plurality of individual threads is used, is schematically illustrated in FIG. 1. The melt-spinning process has a spinning installation 1 which is connected to a plurality of melt generators (not illustrated here). The spinning installation 1 has a heated spinning beam 2 which supports a plurality of spinning nozzles 3.1 to 3.3 beside one another. The spinning nozzles 3.1 to 3.3 on the lower sides thereof have in each case a multiplicity of nozzle bores through which the spinning nozzles 3.1 to 3.3 in each case extrude one filament group from a polymer melt. A cooling installation 4 by way of which the extruded filaments are cooled is provided below the spinning installation 1. The filaments, after cooling, by way of the thread guides 5 are in each case gathered so as to form an individual thread 6.1 to 6.3.

A godet drafting device 9 which has a plurality of driven godets 9.1 is provided for drawing off the individual threads 6.1 to 6.3 from the spinning nozzles 3.1 to 3.3. The individual threads 6.1 to 6.3, prior thereto, are individually entangled by way of a pre-entanglement device 8, by way of a plurality of pre-entanglement nozzles 8.1 to 8.3. The individual threads 6.1 to 6.3 are gathered so as to form a composite thread on the circumference of the godets 9.1 of the godet drafting device 9 and are guided by way of a plurality of wrappings on the circumference of the godets 9.1 of the godet drafting device 9.

After drawing-off and drafting of the individual threads 6.1, 6.2, and 6.3 by the godet drafting device 9, the individual threads 6.1, 6.2, and 6.3, immediately prior to crimping by a crimping device 11, are optionally separated and entangled. To this end, the entanglement device 10 according to the invention is disposed in the thread run between the godet drafting device 9 and the crimping device 11. The entanglement device 10 includes a plurality of entanglement nozzles which are described in more detail hereunder.

The crimping device 11 in this exemplary embodiment is configured by a stuffer-box crimping installation which has a conveying nozzle and a stuffer box. The individual threads 6.1, 6.2, and 6.3 herein are collectively compressed by a hot conveying medium so as to form a thread plug 16. The thread plug 16 is subsequently cooled on the circumference of a cooling drum 12 and untangled so as to form the composite thread 7.

The crimped composite thread 7 is subsequently drawn off from the circumference of the cooling drum 12 by a drawing-off godet unit 13, wherein the thread plug 16 is untangled. Following a post-treatment in a post-entanglement device 14, the composite thread is wound to form a package 17 by a take-up winding device 15. The composite thread that is wound onto the package 17 thus represents a crimped carpet yarn which can be utilized directly for the production of carpets. Carpet yarns of this type for the production of carpets have a pre-determined visual appearance which is defined by the colours of the individual threads. These visual appearances of the composite thread herein are substantially achieved by the entanglement of the individual threads directly prior to crimping. In order for said entanglement to be able to be performed with high flexibility, an exemplary embodiment of the entanglement device 10 according to the invention is described in more detail hereunder.

An exemplary embodiment of the device according to the invention, such as could be used, for example, as the entanglement device 10 in the melt-spinning process illustrated in FIG. 1, is illustrated in a plurality of views in FIGS. 2, 3, 4.1, and 4.2. A plan view is illustrated in FIG. 2, a front view is illustrated in FIG. 3, and in each case one cross-sectional view of the exemplary embodiment is illustrated in FIGS. 4.1 and 4.2. In as far as no explicit reference to the figures is made, the following description applies to all figures.

The exemplary embodiment has a plate-shaped support 10.1. The plate-shaped support 10.1 holds a total of three entanglement nozzles 10.2, 10.3, and 10.4, which are disposed on a reference circle 10.6 at a uniform angular pitch. A thread guide 10.5 is held on the support 10.1 in the centre of the reference circle 10.6. A guide groove 10.7 which penetrates the support 10.1 from a front end side 10.8 is assigned to the thread guide 10.5.

The entanglement nozzles 10.2 to 10.4 that are integrated on the support 10.1 are assigned a plurality of placing slots 10.10, 10.11, and 10.12. The placing slots 10.10 to 10.12 penetrate the support 10.1, wherein the placing slots 10.10 and 10.12 open out towards the front end side 10.8 of the support, and wherein the placing slot 10.11 of the entanglement nozzle 10.3 opens into the guide groove 10.7.

The construction of the entanglement nozzles 10.2 to 10.4 is embodied in an identical manner and will be explained in more detail hereunder by means of the illustrations in FIGS. 4.1 and 4.2. FIG. 4.1 illustrates a cross-sectional view of the entanglement nozzle 10.2 in the region of the compressed air supply, and the cross-sectional view of the entanglement nozzle 10.2 in the region of the placing slot 10.10 is illustrated in FIG. 4.2.

The entanglement nozzle 10.2 is formed by an insert member 10.22 which is held in a receptacle opening 10.25 of the support 10.1. The receptacle opening 10.25 and the insert member 10.22 herein extend from an upper side 10.13 of the support 10.1 and a lower side 10.14 of the support 10.1.

A guide duct 10.29 is configured so as to be preferably centrical in the insert member 10.22. The guide duct 10.29 penetrates the insert member 10.22, and on the upper side 10.13 forms a thread inlet 10.30 and on the lower side 10.14 a thread outlet 10.31.

A compressed air connector 10.15 which by way of a supply bore 10.18 is connected to the receptacle opening 10.25 is configured on a rear end side 10.9 of the support 10.1. A fluid pocket 10.26 into which a transverse slot 10.24 of the insert member 10.22 opens is provided herein between the receptacle opening 10.25 and in the mouth end of the supply bore 10.18. The transverse slot 10.24 penetrates the wall of the insert member 10.22 and connects the guide duct 10.29 to the compressed air connector 10.15.

As can be derived from the illustration in FIG. 4.2, a longitudinal slot 10.23 is configured so as to be offset to the transverse slot 10.24 on the insert member 10.22. The longitudinal slot 10.23 penetrates the wall of the insert member 10.22 from the upper side 10.13 down to the lower side 10.14, and connects the guide duct 10.29 to the placing slot 10.10 on the support 10.1. The placing slot 10.10 penetrates the support 10.1 from a front end side 10.8 to the receptacle opening 10.25. To this extent, a thread can be threaded from the outside into the guide duct 10.29 by way of the placing slot 10.10 and of the longitudinal slot 10.23.

As can be derived from the illustration in FIGS. 2 and 3, the support 1 for each entanglement nozzle 10.2 to 10.4 has separate receptacle openings 10.25, separate placing slots 10.10 to 10.12, and separate supply bores 10.18 to 10.20 having separate compressed air connectors 10.15 to 10.17. Each of the entanglement nozzles 10.2 to 10.4 held on the support 10 can thus be individually used for entangling individual threads. The insert members 10.22 herein are preferably embodied from a wear-resistant material, for example a ceramic or a hard metal, and have a cylindrical shape.

The thread guide 10.5 that is configured in the centre of the reference circle 10.6 is formed by a cylindrical guide member 10.21 which has a U-shaped opening in the region of the guide groove 10.7. The guide member 10.21 herein is likewise held in a receptacle opening 10.25 of the support 10.1. The guide member 10.21 is likewise embodied from a wear-resistant material, for example a ceramic or a hard metal.

In operation, the exemplary embodiment of the device according to the invention illustrated in FIG. 2 can be operated in various manners. There is thus in principle the possibility for a number of three individual threads to be entangled separately in the three entanglement nozzles 10.2, 10.3, and 10.4. On account of the geometric arrangement of the entanglement nozzles 10.2, 10.3, and 10.4 on a reference circle at a pitch of identical size, each individual thread is deflected uniformly from a central guide position. The central guide position herein is substantially determined by the composite thread which is formed collectively from the individual threads and prior to running in is guided on the circumference of a godet.

In the case of the individual threads having to be fed to crimping without entanglement, all individual threads are collectively guided in the thread guide 10.5. In this operational situation, the composite thread can pass the support 10.1 and plunge into the crimping installation without deflection in the straight thread run.

In the case of only single individual threads obtaining an entanglement prior to crimping, the non-entangled individual threads are guided in the thread guide 10.5. The individual thread or threads which is/are entangled is/are guided through one or a plurality of the entanglement nozzles 10.2 to 10.4.

Apart from the purely geometric separation in the thread guiding, the coloration of the composite thread can also be influenced in that the compressed air stream supplied in terms of the intensity and the uniformity thereof is varied at each entanglement nozzle 10.2 to 10.4. Pressure variations or else pulsating compressed air streams can thus be utilized for generating particular colour effects in the composite thread. To this extent, the device according to the invention for entangling individual threads of a composite thread offers a very high flexibility in the embodiment of the entanglements.

In the case of the exemplary embodiment illustrated in FIG. 2, the number of entanglement nozzles and the number of thread guides on the support 10.1 are exemplary. More than three entanglement nozzles can thus also be integrated in the same manner in the support 10.1. Moreover, a plurality of thread guides can also be provided on the support 10.1 in the case of a higher number of individual threads.

It is to be explicitly mentioned at this point that the constructive configuration and the profiles of the placing slots 10.10 to 10.12 are exemplary. It is essential herein that the thread group of the individual threads by means of a suction pistol can be collectively pieced in the entanglement nozzles 10.2 to 10.4.

A further exemplary embodiment of an entanglement device according to the invention is illustrated in a plan view in FIG. 5. This exemplary embodiment is substantially identical to the preceding exemplary embodiment such that only the points of differentiation will be explained at this point.

In the case of the exemplary embodiment illustrated in FIG. 5, the support 10.1 has a protruding support arm 10.27 on the front end side 10.8. The support arm 10.27 is embodied so as to be L-shaped and has an auxiliary thread guide 10.28 that is opposite the thread guide 10.5. The auxiliary thread guide 10.28 is configured so as to be U-shaped, having an opening opposite the thread guide 10.5. The auxiliary thread guide 10.28 is preferably formed by a guide insert which is held on the support arm 10.27.

The exemplary embodiment illustrated in FIG. 5 is particularly suitable for keeping the thread group in a temporarily parked position in the piecing of the individual threads. In particular in the case of melt-spinning processes of the type in which the composite threads are generated as a plurality thereof in parallel, and in which the composite threads are pieced successively on the process apparatuses of the melt-spinning device. A non-critical temporary parking of a composite thread is thus possible on account of the auxiliary thread guide 10.28 on the support 10.1.

The invention claimed is:

1. Device for entangling a plurality of individual threads of a composite thread in a melt-spinning process for the production of crimped yarns, having a plurality of entanglement nozzles which are collectively held on a support, each entanglement nozzle having a separate placing slot, wherein the entanglement nozzles on the support are assigned at least one thread guide, the entanglement nozzles and the at least one thread guide providing respective ducts in such a manner that the ducts guide the threads optionally in the entanglement nozzles and/or in the thread guide, and a guide groove for each thread guide, and wherein the guide groove opens into a respective thread guide of the at least one thread guide, and wherein one of the placing slots opens into the guide groove.

2. Device according to claim 1, wherein the thread guide is held on the support at a constant spacing from the entanglement nozzles.

3. Device according to claim 2, wherein the entanglement nozzles are disposed on a reference circle about the at least one thread guide, and wherein the entanglement nozzles are disposed on the reference circle at a regular pitch.

4. Device according to claim 3, wherein each thread guide is formed by a U-shaped guide member which is disposed on a groove base of the respective guide groove that penetrates the support at an end side.

5. Device according to claim 4, wherein at least one of the entanglement nozzles is formed by an insert member which is held in a receptacle opening of the support.

6. Device according to claim 5, wherein the support is configured so as to be plate-shaped and has a respective placing slot of the placing slots that opens laterally into the receptacle opening, and wherein the respective receptacle opening and the respective placing slot penetrate the support from an upper side to a lower side.

7. Device according to claim 6, wherein a supply bore which extends between the receptacle opening and a compressed air connector that is configured on a distal end side of the support is configured within the support.

8. Device according to claim 7, wherein the support for each entanglement nozzle has separate receptacle openings and separate supply bores having separate compressed air connectors.

9. Device according to claim 8, wherein the insert member is formed from a wear-resistant material, and wherein the insert member has the respective duct which by way of a longitudinal slot is connected to the respective placing slot in the support and by way of a transverse slot s connected to the respective supply bore in the support.

10. Device according to claim 1, wherein the support has a protruding support arm which has an auxiliary thread guide that is spaced apart so as to be opposite the thread guide, the threads when being placed being able to be guided through said auxiliary thread guide so as to be temporarily parked therein.

11. Device according to claim 1, wherein the at least one thread guide is different from the entanglement nozzles.

12. Device for entangling a plurality of individual threads of a composite thread in a melt-spinning process for the production of crimped yarns, the device comprising:

a thread guide that defines a thread guide duct;

entanglement nozzles the define respective nozzle ducts; and a support that holds the thread guide and the entanglement nozzles in fixed positions relative to each other, the support defining (i) an outer edge, (ii) a guide groove that extends from the outer edge into the thread guide duct defined by the thread guide, and (iii) separate placing slots that extend into the respective nozzle ducts defined by the entanglement nozzles, and wherein one of the placing slots opens into the guide groove.

13. Device according to claim 12 wherein the support further defines an upper side and a lower side;

wherein each of the thread guide duct and the respective nozzle ducts has an upper opening that opens on the upper side and a lower opening that opens on the lower side; and wherein each of the guide groove and the separate placing slots extends completely from the upper side to the lower side.

14. Device according to claim 12 wherein a portion of the outer edge defined by the support forms a front access side of the support; and wherein the guide groove opens toward the front access side of the support.

* * * * *